US005972546A

United States Patent [19]

Bjelkhagen

[11] Patent Number: 5,972,546

[45] Date of Patent: Oct. 26, 1999

[54] SECURE PHOTOGRAPHIC METHOD AND APPARATUS

[75] Inventor: Hans I. Bjelkhagen, Chicago, Ill.

[73] Assignee: Photics Corporation, Lake Forest, Ill.

[21] Appl. No.: 09/012,157

[22] Filed: Jan. 22, 1998

[51] Int. Cl.[6] ..... G03C 1/76; G03C 1/77

[52] U.S. Cl. ..... 430/10; 430/568; 430/290; 283/77; 283/112; 283/904

[58] Field of Search ..... 430/10, 568, 290; 283/77, 112, 904

[56] References Cited

U.S. PATENT DOCUMENTS

| | | | |
|---|---|---|---|
| 3,503,050 | 3/1970 | Schools et al. | 365/106 |
| 3,523,790 | 8/1970 | Grobin, Jr. | 430/17 |
| 4,054,453 | 10/1977 | Grobin, Jr. | 430/525 |
| 4,178,181 | 12/1979 | Sawyer | 430/524 |
| 4,835,090 | 5/1989 | Sawyer | 430/367 |
| 5,449,597 | 9/1995 | Sawyer | 430/523 |
| 5,494,787 | 2/1996 | Sawyer | 430/524 |
| 5,605,784 | 2/1997 | Sawyer | 430/367 |
| 5,629,143 | 5/1997 | Sawyer | 430/524 |
| 5,856,048 | 1/1999 | Tahara et al. | 430/1 |

OTHER PUBLICATIONS

Abramson et al, "Sandwich Holography for Strong Information Interferometrically With a High Degree of Security," Applied Optics, vol. 18, No. 12, pp. 2017–2021.

*Primary Examiner*—Mark F. Huff
*Attorney, Agent, or Firm*—Niro, Scavone, Haller & Niro

[57] ABSTRACT

The application of Lippmann photographs as a unique security device on security documents, such as, e.g. identity cards, passports, credit cards is presented. The recording of such photographs requires a special type of photosensitive film layer in contact with a reflecting layer. Panchromatic photopolymer materials can be used and, after being recorded and processed, laminated to security documents. Lippmann photographs are almost impossible to copy and, certainly, cannot be copied by conventional photography or color copying machines.

16 Claims, 2 Drawing Sheets

SECURE PHOTOGRAPHIC METHOD AND APPARATUS

BACKGROUND OF THE INVENTION

This invention relates to the field of photography and, specifically, to a special type of color photographs of the Lippmann type ("Lippmann photography") also known as interferential photography or interference color photography. Lippmann photography is discussed in the following articles, 1) G. Lippmann: La photographic des couleurs. *Comptes Rendus Hebdomadaires des Séances de l'Academie des Sciences* 112, 274–275 (1891); 2) G. Lippmann: Photographies colorées du spectre, sur albumine et sur gélatine bichromatées, *Comptes Rendus Hebdomadaires des Séances de l'Academie des Sciences* 115, 575 (1892); and 3) G. Lippmann: Sur la théorie de la photographie des couleurs simples et composées par la méthode interférentielle. *J. Physique* 3 (No.3), 97–107 (1894), each of which is expressly incorporated herein by reference. It was the first type of true-color photography, invented by Gabriel Lippmann in 1891. In this type of photography, colors are recorded in a photosensitive layer as a black-and-white interference structure. Such an image can be used as a security device on different types of security documents, such as passports, identity cards, travel documents, drivers licenses, credit cards, etc. The present invention involves the methods of application of Lippmann photography for security and anti-counterfeiting purposes including the technique of recording such photographs, the special recording materials, and the recording and processing devices for this type of photography unique to the security application.

PRIOR ART

Although the first photographic color recording technique of the Lippmann type was extremely interesting from a scientific point of view, it was not very effective for color photography since the technique was complicated and the exposure times at that time were too long for practical use. The difficulty in viewing the photographs was another contributing factor in addition to the copying problem, which prevented Lippmann photography from becoming a practical photographic color recording method. However, one hundred year old Lippmann photographs are very beautiful with high resolution and good color contrast. The fact that the colors are so well preserved indicates something about their archival properties. Gabriel Lippmann was awarded the physics Nobel prize for his invention in 1908.

The above mentioned limitations of the Lippmann technique, which made this type of color photography impractical, have now become important advantages of the new type of security application of Lippmann photography presented here.

The principle of Lippmann photography is shown in FIG. 1. Because of the demand for high resolving power for recording Lippmann photographs, normally the recording material has a rather low light sensitivity. The photosensitive emulsion coated on Lippmann plates is brought in contact with a highly reflecting surface. Lippmann used mercury in contact with the emulsion. This mirror reflects the light into the emulsion, which then interferes with the light coming from the other side of the emulsion. Stationary standing waves of the interfering light produce a very fine fringe pattern throughout the emulsion with a periodic spacing of $\lambda/(2n)$ that is recorded ($\lambda$ is the wavelength of light in air and n is the refractive index of the emulsion). The color information of the object is recorded in this way. For example, large separation between the fringes in the emulsion, indicates that the recorded wavelength is located at the red end of the spectrum. Closer spaced fringes indicate a shorter wavelength, such as green or blue. This description is only correct when rather monochromatic colors are recorded. A polychrome recording is more complex and the interference pattern is aperiodic and is only located in a very thin volume close to the emulsion surface.

When the developed photograph is viewed in white light, different parts of the recorded image produce different colors. This is due to the separation of the recorded fringes in the emulsion. The light is reflected off these fringes, creating different colors corresponding to the original ones that produced them during the recording. It is obvious that there is a high demand on the resolving power of the photosensitive layer to record the fringes separated in the order of half the wavelength of the light. It is also clear that the processing of these plates is critical, as one is not allowed to change the separation between the fringes since that would create wrong colors. In addition, one has to find ways of obtaining high efficiency.

The first plates that Lippmann used were albumen emulsions containing potassium bromide. The plates were sensitized in a silver bath, washed, flowed with cyanine solution and dried. The sensitivity was extremely low. Exposure times of one hour or more were needed. It was not until Auguste and Louis Lumière in Lyon introduced very fine-grained silver-halide gelatin emulsions that such emulsions became the main recording material for Lippmann photography. These plates were much faster than the earlier albumen or collodion plates. Using the silver-halide emulsion, the exposure time was only a few minutes rather than hours.

The recording procedure using the mercury plate holder was straightforward and more or less the same for all experimenters of that time. The main problem for the early Lippmann photographers was the recording material. The preparation of the emulsion and the processing of the plates were absolutely critical in order to obtain good color photographs. The processing of the color photographs was more or less done in the same way by most of the early experimenters. They used developers based on pyrogallol and ammonia, which were formulated to suit the particular emulsion.

Modern holography shows similarities to Lippmann photography. In both cases an interference pattern is recorded in a high-resolution emulsion. For example, the Kogelnik theory for holography is also partly applicable to Lippmann photography. The Bragg diffraction regime applies to both categories. The fundamental difference is that, in the Lippmann case, there is no phase recording involved; the recorded interference structure is a result of phase-locking the light by the reflecting mirror. In holography, the phase information is actually recorded, being encoded as an interference pattern created between the light reflected from the object and a coherent reference beam.

Recording of monochromatic or polychromatic spectra has to be treated differently in Lippmann photography. The recording of monochromatic light in a Lippmann emulsion is easy to understand, and it is similar to recording a reflection volume hologram. A broadband polychromatic spectrum, such as a landscape image, is very different. In this case, the recorded interference structure in the emulsion is located only very close to the surface of the emulsion in contact with the reflecting mirror. Thus, an emulsion thickness of only a few micrometers is needed and actually preferred.

There was very little interest in making silver-halide emulsions of the Lippmann type after this type of photography disappeared in the beginning of the 20th century. However, the need for such plates came back when holography started to become popular in the early 1960s.

The existing patents in the field of Lippmann photography are very few. Mainly, techniques of making ultra-high-resolution silver-halide emulsions suitable for Lippmann photography have been patented. U.S. Pat. No. 4,108,661, entitled Lippmann-emulsions and reversal processing thereof, issued Aug. 22, 1978, is an example of such a patent. A rather recent patent on the Lippmann technique, U.S. Pat. No. 5,605,784, entitled Lippmann process of color photography, which produces a photograph with a 2-dimensional image, to result in another process of color photography, which produces a photograph with a 3-dimensional image, issued Sep. 12, 1995, describes a technique of producing 3-dimensional photographic images based on the Lippmann technique. Each of these patents is expressly incorporated herein by reference.

There are a few patents on the technique of attaching a reflecting layer to a silver-halide emulsion for Lippmann photography. U.S. Pat. No. 4,054,453, entitled Lippmann film with reflective layer, issued Oct. 18, 1977, describes the technique of using a translucent dissolvable sublayer in-between a silver-halide emulsion and a reflecting layer which can be soluble or insoluble. However, the described technique is not very effective for producing Lippmann photographs. If the reflecting layer is not in perfect contact with the photosensitive coating, the part of the interference pattern that may reach the emulsion will be very weak, or the interference pattern may not even reach the recording emulsion at all. The thickness of the sublayer has to be practically zero, for the method to work in ordinary white light. In two recent similar patents, U.S. Pat. No. 5,494,787, entitled Photosensitive element compromising a non-silver halide photosensitive layer and a reflecting layer compromising indium or gallium, issued Feb. 27, 1996 and U.S. Pat. No. 5,629,143, Photosensitive element compromising a photosensitive layer and a reflecting layer compromising indium or gallium, issued May 13, 1997, the technique of combining a (any) photosensitive layer with a reflecting layer of indium or gallium is described. In U.S. Pat. No. 5,494,787 it is mentioned that the photosensitive layer is a non-silver-halide layer and the reflecting layer comprising indium or gallium. In a previous patent, U.S. Pat. No. 4,178,181, Dec. 11, 1979, entitled Interference film photography, it is mentioned that the photosensitive layer is a silver-halide layer and the reflecting layer comprising indium or gallium. Each of these patents is expressly incorporated herein by reference.

Other recent publications on Lippmann photography are mainly historic papers on this old photographic technique. In February 1997, at a SPIE conference in San Jose, Calif., the present inventor reported on the possibility to record Lippmann photographs in thin photopolymer materials combined with a special reflecting foil of sputtered silver and without any protective overcoat of, e.g., the commonly used indium oxide. 4. H. I. Bjelkhagen: Lippmann photographs recorded in DuPont color photopolymer material, in *Practical Holography XI and Holographic Materials III,* ed. by S. A. Benton, T. J. Trout. Proc. SPIE 3011, 358–366 (1997). This article is expressly incorporated herein by reference. Using this technique it is possible to obtain high-quality Lippmann photographs. This technique will be further described herein.

SUMMARY OF THE INVENTION

The use of Lippmann photographs as a unique security device on security documents, such as, e.g. identity cards, passports, credit cards is presented. The recording of such photographs requires a special type of photosensitive layer in contact with a reflecting layer. Panchromatic photopolymer materials can be used and, after being recorded and processed, laminated to security documents. Lippmann photographs are almost impossible to copy and, certainly, cannot be copied by conventional photography or color copying machines.

Lippmann photography can offer a new type of security device which can be unique and individually produced for each security document. Some of the advantages of Lippmann photography as a security device are:

1. Recording equipment (cameras) for Lippmann photography can be manufactured to be used by security document producers and institutions issuing security documents.
2. The recording is rather simple to perform, no lasers are needed or no specially trained operators are required.
3. The access to the recording photosensitive film, e.g. the DuPont special photopolymer materials, can be strictly controlled by the manufacturer of the film. Only approved producers of security documents and institutions issuing such documents can order the film from the film manufacturer.
4. The cost of a Lippmann photograph is low.
5. The Lippmann photograph has a very high archival stability.
6. The Lippmann photograph is Bragg sensitive, which means it change its color depending on the angle of observation.
7. The Lippmann photograph cannot be copied by conventional color photography nor can it be copied on color copy machines.
8. The Lippmann photograph is completely transparent. The image is only visible under certain illumination. It can be laminated to a security document in such a way that printed information or other information can be visible through the Lippmann photograph.
9. The Lippmann photograph can be laminated to a light-absorbing material (e.g. black plastic foil), which means that it is not possible to see through the Lippmann photograph.
10. Since the resolution of the Lippmann photograph is extremely high, a reduced image of the security document can be laminated to the document, only occupying a very small area of it. In this case, magnifying techniques may be necessary to be able to read the recorded information in the Lippmann image.

DETAILED DESCRIPTION OF THE PREFERRED EMBODIMENT

Figure 1:
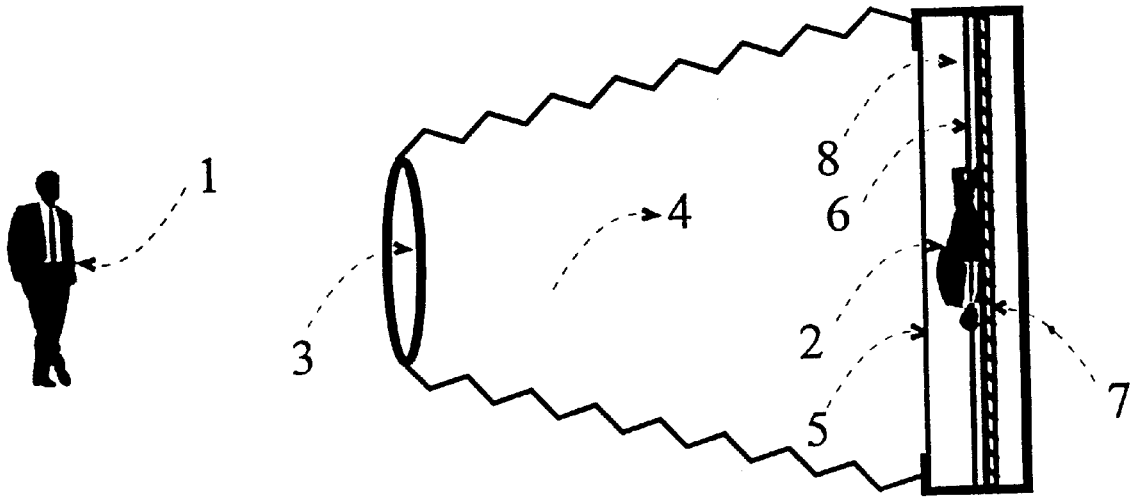
FIG. 1 is a schematic diagram of the principle of Lippmann photography.

Recent progress in development of high-resolution photosensitive recording materials has opened up new possibilities to investigate the old Lippmann photography technique again. New and improved recording materials (silver-halide and photopolymer materials) combined with special processing techniques can make Lippmann photography an interesting imaging technique for very special applications. In particular, the difficulties in copying such photographs, the ultra-high image resolution and the Bragg sensitivity of such photographs make them very suitable for security applications.

In order to record Lippmann photographs a special camera is needed in which glass plates or sheets of film can be exposed. For example, an Eastman Kodak Co. (Folmer & Schwing Div.) Auto Graflex 4" by 5" camera equipped with a Kodak Aero Ektar F:2.5, 178 mm lens is suitable. This camera can accommodate both sheet film and glass plates. For the security application, a special Lippmann camera can be manufactured, in which a roll of the photosensitive film, prelaminated with a reflecting foil, is exposed. Special illuminating lamps, such as strong halogen spotlights are needed in order to record the security documents with a reasonably short exposure time. The main photosensitive materials to be used for Lippmann photography are ultra-high-resolution silver-halide panchromatic materials, panchromatic photopolymer materials, and panchromatic dichromated gelatin materials. However, for the security application the most convenient recording material is the photopolymer material. In particular, the new type of photopolymer developed by E.I. du Pont de Nemours & Co. is very suitable. It is understood that the Fuji and Polaroid companies also produce suitable photopolymers. A special type of photopolymer material is needed for Lippmann photography. The photosensitive photopolymer layer has to be rather thin, in the order of a few micrometers only. The photopolymer layer has to be coated on a flexible transparent base and a special type of reflecting foil has to be laminated to the photosensitive polymer layer in absolute perfect contact with it.

Silver-halide recording materials

Recording a Lippmann photograph on silver-halide emulsion can be done in at least three ways as follows:

1. The plate is inserted in a mercury plate holder according to the old Lippmann procedure. A mercury-holding dark slide has to be manufactured, in order to fit the camera being used.
2. A thin layer of aluminum or silver is deposited on the emulsion side of the unexposed plate in a vacuum chamber. A technique of performing this without affecting (fogging) the unexposed plates has to be used. Applying a sputtering technique is another possibility. After that, the plate is inserted in a conventional glass plate holder with the back of the plate facing the lens. Before the plate is developed the Al-coating or Ag-coating is dissolved from the emulsion surface.
3. However, it is not necessary to use mercury or any other metal reflector. The gelatin-air interface can act as a reflector of light. In this case, it is very easy to record Lippmann photographs on silver-halide materials.

The idea of using the gelatin-air interface reflector instead of the common mercury technique is not new. In 1904, Rothé published a paper where he claimed having recorded a variety of Lippmann photographs without using mercury, instead using the gelatin-air interface. That article is entitled, E. Rothé: Photographies en couleurs obtenues par la méthode interférentielle sans miroir de mercure. *Comptes Rendus Hebdomadaires des Séances de l'Academie des Sciences* 139, 565–567 (1904), and is expressly incorporated herein by reference. He also mentioned that the quality was almost as good as photographs recorded with the mercury-holding dark slide. The reason why it is possible to obtain a Lippmann photograph without mercury can be explained in the following way. One must study the difference between a reflection at the mercury surface or obtained at the gelatin-air interface. A node is located at the mercury reflector (an optically thicker medium than gelatin), which means at the gelatin surface. The phase shift there is $\pm\pi$. On the contrary, a crest is located at the surface when the reflection is obtained from the gelatin-air interface (an optically thinner medium than gelatin), which means, since no phase shift occurs in this case, a silver layer will be created at the emulsion surface after development. In the mercury case the first silver layer is located at a distance of $\lambda/4$ inside the gelatin emulsion. In regard to the second silver layer, it will be $\lambda/4$ closer to the gelatin surface compared to the mercury reflector case. Since the coherence length of ordinary light is extremely short, the difference in distance from the gelatin surface is very important. The slightly increased modulation (caused by a higher degree of coherence) in the gelatin-air reflector case can somewhat compensate for the weaker reflection obtained in this case. When the plate is exposed without mercury, the exposure time is increased compared to a recording with a mercury reflector. After the exposure is finished, the plate holder is removed from the camera and the plate processed in a darkroom.

Photopolymer materials

The panchromatic photopolymer materials from E.I. du Pont de Nemours & Co. are extremely interesting and easy to use for Lippmann photography. Although, being less sensitive than the ultra-high-resolution silver-halide emulsion (which is also slow, according to modern photographic standards), it has its special advantages of easy handling and dry processing (only UV-curing and baking).

As an example, the recording of a Lippmann photograph on photopolymer material can be done in the following way. The color photopolymer material having an emulsion thickness of about 2 to 3 $\mu$m is preferred. Such experimental materials have been manufactured by DuPont, e.g. HRF-700X071-3. Before the recording takes place, a reflecting mirror foil has to be laminated to the polymer film. For example, as a reflecting surface, silver sputtered (800 Å) polyester film without the standard anti-dust oxide (InO) top layer can be used. This highly reflecting foil, produced by, e.g., Courtaulds Performance Films, has to be laminated to the photopolymer layer before the recording of a Lippmann photograph can be performed. The mirror foil is laminated to the photopolymer material under safelight and then, e.g., loaded in a conventional sheet film holder. The film cassette is then attached to the back of a camera. A correction filter may be needed in front of the camera lens to obtain correct color balance if the recording material is not perfectly isochromatic. The reflection foil can also be pre-laminated to the photopolymer material by the manufacturer of the photopolymer material.

After being exposed to the image-forming information in the camera, the film has to be processed. The reflecting foil is detached from the photopolymer film and the photopolymer layer has to be exposed to strong white light or ultra-violet light for developing. DuPont recommends about 100 mJ/cm$^2$ exposure at 350–380 nm. After that, the photograph is put in an oven at a temperature of 120° C. for a certain time in order to increase the brightness of the image. The whole processing technique of the photopolymer film is a completely dry processing technique. This fact makes it a very convenient method to be used by companies and institutions issuing security documents. In addition, the Lippmann photograph recorded on photopolymer can easily be laminated to the security document. The polymer film contains no dyes or any fading chemicals, which means, the archival stability is expected to be very high. The photograph is simply a piece of plastic material with the information recorded in it as an optical phase structure (refractive index variations within the photopolymer layer).

Security applications of Lippmann photographs

Currently, applications of holograms (laser-recorded three-dimensional images) are common in the field of security, where mass-produced embossed holograms are attached to many types of security documents and credit cards. In almost every case where holograms are used, exactly the same hologram image is attached to a large quantities of security documents of the same type, e.g. the embossed dove hologram on the VISA credit cards. Since holograms are difficult to manufacture and lasers are needed for the actual recording of a hologram, the use of holograms has been a valuable security device over many years. However, nowadays it is relatively easy to copy holograms and there are many examples of illegally copied security holograms reported. A holographic system with a very high degree of security has been patented by the present inventor (U.S. Pat. No. 4,120,559). There are several patents on the use of holograms for security applications.

Referring to FIG. 1 for recording of a Lippmann photograph, the object 1 is illuminated with ordinary white light (daylight or artificial light of the visible electromagnetic spectrum). An image 2 of the subject is generated by the lens 3 of the camera 4. At the position of the image 2, a high-resolution photosensitive device 5 is position in such a way the photosensitive layer 6 of the recording device is in contact with a light-reflecting mirror 7, e.g. mercury. The device can be a photosensitive layer coated on a stable substrate 8, such as, e.g., glass, or on a flexible substrate, such as, e.g., a polyester or triacetate film. The photosensitive device 5 is exposed during a certain amount of time (the exposure time) to the interference structure generated by the light from different parts of the object and the corresponding light reflected back into the photosensitive layer 6 from the reflector 7.

The photosensitive layer coated on the glass plate 5 needs to be sensitive to the visible part of the electromagnetic spectrum. This layer can be an ultra-high-resolution silver-halide emulsion, panchromatically sensitized. However, other panchromatic ultra-high-resolution materials such as, e.g., photopolymer materials can also be used for recording Lippmann photographs. Dichromated gelatin materials have a resolution high enough to be considered for Lippmann photography as well.

The chemical processing (development) of a silver-halide photographic plate upon exposure is rather critical in order to obtain a high-quality color photograph. Emulsion shrinkage and other emulsion distortions caused by the active solutions used for the processing must be avoided. In addition, washing and drying of the plate must be done so that no shrinkage occurs. The processing baths and the color processing procedure are depending on the recording material used.

Figure 2:
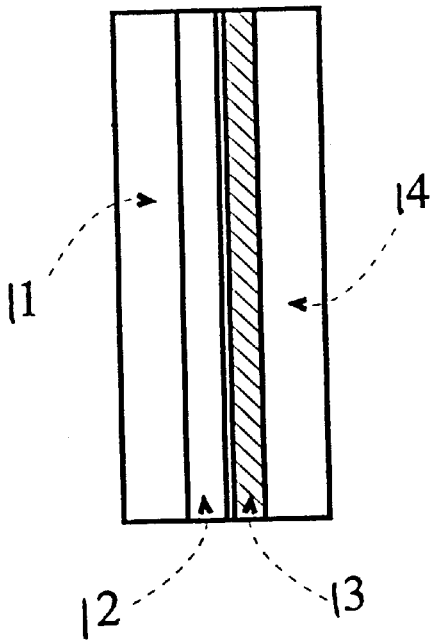
FIG. 2 is a schematic drawing of the photopolymer recording film laminated to a reflecting layer.

Referring to FIG. 2, the recording of security Lippmann photographs is best performed using panchromatic photopolymer materials. On a transparent substrate material 11, a photosensitive panchromatic photopolymer layer 12 is coated. The thickness of the photopolymer layer 12 has to be rather thin, i.e. between 1 and 3 $\mu$m for working well for Lippmann photography. The photopolymer layer coated on the substrate has to be laminated to a reflecting material 13, prior to exposure of the Lippmann photograph in the recording camera. The reflecting layer can be a layer of e.g. sputtered silver on a flexible base 14. The reflecting layer 13 has to be in almost perfect contact (less than a fraction of a micrometer) with the photopolymer layer 12 in order to record high-quality Lippmann photographs. The lamination of the reflection foil can be performed by the manufacturer of the photopolymer material or else it can be laminated to the photopolymer material just before recording a Lippmann photograph. Some photopolymer materials, such as the DuPont materials, only need a dry processing technique.

Figure 3:
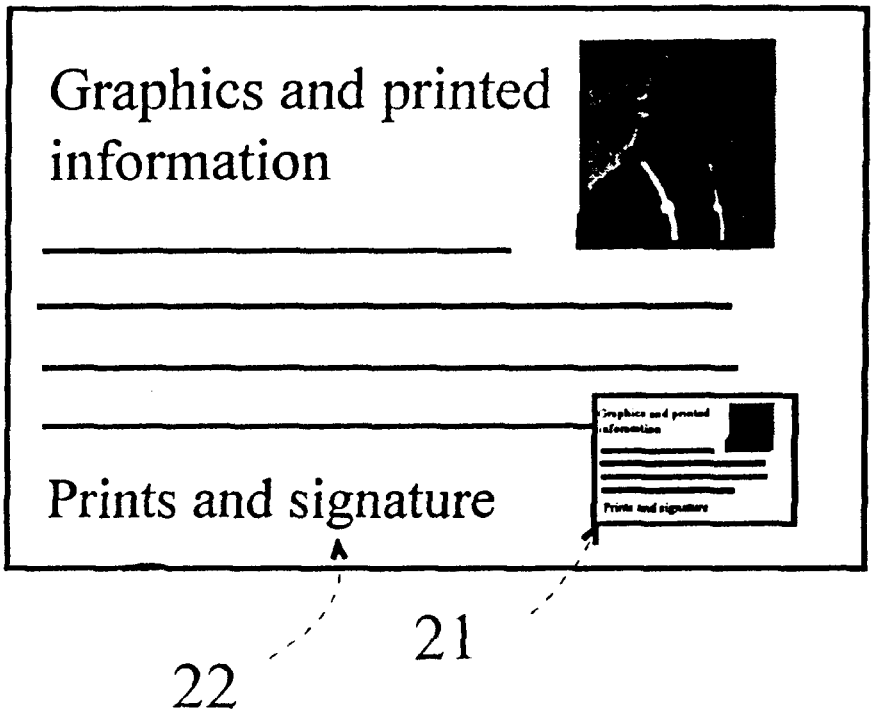
FIG. 3 is a drawing of a security document to which a Lippmann photograph has been attached.
Figure 4:
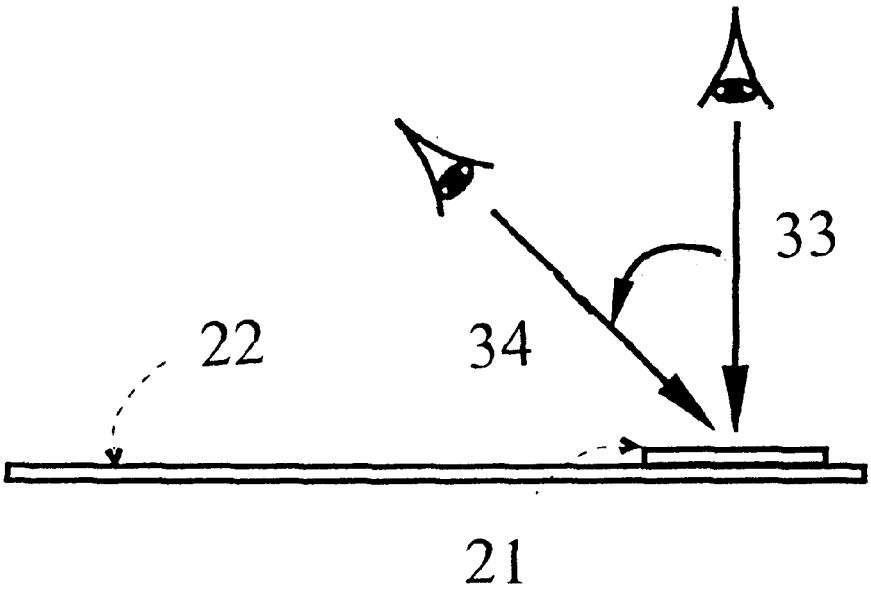
FIG. 4 is a side planar view of the security document shown in FIG. 3.

Referring to FIG. 3, in which a Lippmann photograph 21 has been attached to a security document 22, the color of the image in the Lippmann photograph varies depending on the angle of observation. Perpendicular observation shown as arrow 33 in FIG. 4 gives the correct-color image, oblique observation as shown by arrow 34 in FIG. 4 shifts the colors toward shorter wavelengths (red becomes yellow-green, green becomes blue, etc). Because of this feature, known as the Bragg sensitivity, it is not possible to replace a Lippmann color photograph with a conventional color photograph, nor can the security document with the Lippmann photograph be copied in a color copier. The Bragg selectivity of the Lippmann color photograph makes it a very unique type of photograph, very different from modern conventional color photographs. The Lippmann photograph is a recording of the entire spectrum of the object, conventional color photography is based on Maxwell's three-color principle (red, green, blue).

One important question is whether a Lippmann photograph can be copied by using the Lippmann photography technique, i.e. by recording a Lippmann photograph of another Lippmann photograph, or in the case of a tampered or falsified security document record a Lippmann photograph of it. Certainly, in the case of recording a Lippmann photograph of a tampered or falsified security document, it is possibly to record such an image by somebody familiar with Lippmann photography and assuming that such a person can get access to the recording material for a Lippmann photograph, e.g the DuPont photopolymer material.

Copying an existing Lippmann photograph by recording another Lippmann photograph of it is extremely difficult. In Lippmann photography there is no negative involved, each photograph is unique, one of its kind. The illumination for recreating a color-correct image of a Lippmann photograph has to be perpendicular to the image. The recording of such an image has to be performed perpendicular as well, which means that the camera will block the light that is needed to illuminate the original Lippmann photograph. In the early days of Lippmann photography a glass prism (a wedge) was laminated to the Lippmann photograph to avoid the surface reflection off the photographic plate to interfere with the image recorded. In the case of security Lippmann photographs, no prism will be laminated to the photographs. It is not necessary for viewing and checking the authenticity of the security device itself, but without a prism, it is impossible to re-record it, using Lippmann photography. Even if the security Lippmann photograph was laminated to a prism it is still difficult to illuminate it correctly and at the same time record a color-correct Lippmann photograph of it. The quality of such a copy will be very poor and significantly different from an original Lippmann photograph.

Several permutations of the security devices of the present invention exist. The Lippmann photograph may cover the entire front and rear sides of a security document, or only a portion of either or both sides. The security document may carry analogue and/or binary information recorded in the Lippmann photograph. The document may contain all of or a portion of any data stored in the Lippmann photograph in any conventional manner on the security document. To record the Lippmann photographs, a special film is used comprising a high-resolution panchromatic photosensitive recording material constituting a substrate and a light-sensitive layer to which a reflective foil is laminated with no intervening sublayer. The panchromatic photopolymer material can be a flexible substrate. The preferred thickness of the photopolymer layer is between 1 to 3 $\mu$m. The reflective foil is a thin metal material, preferably aluminum or silver. The photopolymer layer is preferably laminated to the highly reflective foil of sputtered or vacuum deposited silver or aluminum on a flexible substrate. Preferably, the reflecting foil has no protective layer attached to it.

Of course, it should be understood that various changes and modifications to the preferred embodiments described herein will be apparent to those skilled in the art. Other changes and modifications, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

What is claimed is:

1. A security device containing information thereon, comprising:

a body having two sides, at least one side of which is adapted to receive said information, said information comprising:

an image which is reproduced onto a photosensitive photopolymer by Lippman photography;

said photopolymer applied to a reflecting surface upon which surface a transparent substrate is co-extensively bonded; and a protective transparent lamination disposed over said information.

2. The device of claim 1 wherein said photopolymer is 2 to 3 micrometers in thickness.

3. The device of claim 1 wherein said image is in the form of binary code.

4. The device of claim 1 wherein said reflecting surface is a reflective foil.

5. The security device of claim 1 wherein said device is a credit card and said information covers a portion of said device.

6. The security device of claim 1 wherein said reproduction resistant information is only reproduced in a correct-color image by perpendicular observation.

7. The security device of claim 1 wherein said image is a Lippman photograph of a human.

8. A method of creating a security device having an image thereon which may only be reproduced through Lippman photography comprising:

selecting an image;

using Lippman photography to reproduce said image on a first substrate comprised of a photopolymer emulsion which has been applied to a a reflective surface which surface is bonded to a transparent film;

affixing said image to a second substrate to form said security device.

9. The method of claim 8 further comprising placing a protective transparent layer over said image.

10. The method of claim 8 wherein said photopolymer emulsion is 1 to 3 micrometers in thickness.

11. The method of claim 8 wherein said image only reproduces correct-color image by perpendicular observation.

12. The method of claim 8 wherein the Lippman photography used includes dry processing of said image.

13. The method of claim 8 wherein said reflective surface is bonded to said transparent film and said photopolymer emulsion prior to reproducing said image by Lippman photography.

14. A credit card comprising:

a base having two opposing sides;

unique identifying indicia applied to at least a portion of at least one of said sides;

said identifying indicia is comprised of a photograph created by using Lippman photography wherein said identifying indicia is only reproducible by Lippman photography.

15. The credit card of claim 14 wherein a protective transparent layer is applied over said photograph.

16. The credit card of claim 14 wherein said photograph only produces a correct-color image by perpendicular observation.

* * * * *